US007597589B2

(12) United States Patent
Kawamura

(10) Patent No.: US 7,597,589 B2
(45) Date of Patent: Oct. 6, 2009

(54) CONNECTOR FOR ACCOMODATING ERRONEOUS POSITIONING OF A TERMINAL IN A CAVITY

(75) Inventor: Masayuki Kawamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/248,983

(22) Filed: Oct. 10, 2008

(65) Prior Publication Data

US 2009/0098779 A1 Apr. 16, 2009

(30) Foreign Application Priority Data

Oct. 12, 2007 (JP) ..... 2007-266181

(51) Int. Cl.
*H01R 13/40* (2006.01)

(52) U.S. Cl. ..... 439/595; 439/871

(58) Field of Classification Search ..... 439/595, 439/871

See application file for complete search history.

(56) References Cited

U.S. PATENT DOCUMENTS 4,992,064 A * 2/1991 Steinhardt et al. ..... 439/845
7,101,217 B2 9/2006 Hayashi

* cited by examiner

*Primary Examiner*—Tho D Ta
(74) *Attorney, Agent, or Firm*—Gerald E Hespos; Anthony J. Casella

(57) ABSTRACT

A housing (10) made of synthetic resin, in which plate-like terminals (20) are to be accommodated, is formed with cavities (14), into which the terminals (20) are inserted, and resin locking lances (16) extending along surrounding walls (15) of the cavities (14). An engaging projection (16B) engageable with an engaging hole (22) of the terminal (20) projects from the resin locking lance (16). A clearance CL for permitting displacements of the terminal (20) is defined between a facing wall (15L) of the surrounding wall (15) of the cavity (14) facing the resin locking lance (16) and a main body (16A) of the resin locking lance (16) excluding the engaging projection (16B). A projecting distance of the engaging projection (16B) is longer than a difference between the dimension of the clearance and the thickness of the terminal (20).

16 Claims, 9 Drawing Sheets

CONNECTOR FOR ACCOMODATING ERRONEOUS POSITIONING OF A TERMINAL IN A CAVITY

BACKGROUND OF THE INVENTION

1. Field of the Invention

The invention relates to a connector, in which a plate-like terminal is retained by a resin locking lance.

2. Description of the Related Art

U.S. Pat. No. 7,101,217 discloses a connector that has a housing formed with cavities and resin locking lances adjacent the cavities. Each lock lance has a main body and an engaging projection that projects from the main body. Plate-like terminals are inserted into cavities. Each terminal is formed with an engaging hole that receives the engaging projection of the respective locking lance to hold the terminal in the cavity. Parts of the terminal near the engaging hole are squeezed between a wall of the cavity and the main body of the resin locking lance. A front end portion of the terminal before the engaging hole projects forward from the housing and is bolted on an upper surface of a terminal mount.

The upper surface of the terminal mount and the front end portions of the terminals may be displaced vertically from preferred positions due, for example, to a shape error of the terminal mount. As a result, the terminals may be warped to correct the displacement sufficiently for the front end portions of the terminals to be bolted.

A correction of the error in this way causes the part of the terminal squeezed between the main body of the locking lance and the surrounding wall of the cavity to be pressed against the locking lance or the surrounding wall. Maintenance of this pressed state for a long time can affect the durability of the connector. Therefore a further improvement is hoped for.

The present invention was developed in view of the above situation and an object thereof is to provide a connector with good durability.

SUMMARY OF THE INVENTION

The invention relates to a connector with a housing formed with at least one cavity for receiving a terminal. A locking lance is provided at a surrounding wall of the cavity. The locking lance has a main body and an engaging projection projects from the main body for engaging an engaging portion of the terminal. A clearance is formed between the main body of the locking lance and the wall of the cavity that faces the locking lance and/or a part of the surrounding wall where the locking lance is formed for permitting displacement of the terminal. A projecting distance of the engaging projection is longer than a difference between the dimension of the clearance and the thickness of the terminal.

The housing preferably is made of synthetic resin and the terminal preferably is a plate-shaped terminal.

An error in a connected position of the terminal with a mating side may exist. However, such an error is absorbed by a displacement of the terminal in the cavity. Accordingly, the terminal will not be pressed against the resin locking lance or the surrounding wall of the cavity to absorb the error. As a result, durability is improved. Further, the terminal is retained reliably by the locking lance even if the terminal is displaced in the cavity.

The locking lance preferably is at an upper wall of the cavity above the terminal. Thus, the weight of the terminal will not act on the resin locking lance and durability is improved further.

An outer surrounding wall preferably is provided outside the surrounding wall of the cavity and a sealing ring preferably is mounted on an outer peripheral surface of the outer surrounding wall.

At least one reinforcing wall may extend between and connect the surrounding wall and the outer surrounding wall. The reinforcing wall assures that a resilient force of the seal ring does not deform the outer surrounding wall.

The reinforcing walls may be connected with corners of the surrounding wall. Thus, the surrounding wall is unlikely to be deformed even upon receiving a force from the reinforcing wall. Therefore, the clearance in the cavity can be kept in a specified size.

The reinforcing walls may extend parallel to panels of the surrounding wall from corners of the surrounding wall. In this way, a force receiving direction of the surrounding wall from the reinforcing wall coincides with the direction of the surrounding wall. Bending rigidity in the direction of the surfaces of the panels of the surrounding wall is drastically higher than bending rigidity in the thickness direction. Thus, a force from the reinforcing wall will not deform the surrounding wall.

The clearance may exceed the thickness of the terminal. Thus, an error in the connected position of the terminal with the mating side can be in the thickness range of the terminal. Accordingly, the terminal will not be pressed together with the resin locking lance or the surrounding wall of the cavity.

The locking lance may be substantially cantilever-shaped.

The clearance may be larger the sum of an error range of a terminal mount onto which the terminal is to be mounted, an error range of the terminal and an error range of the housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
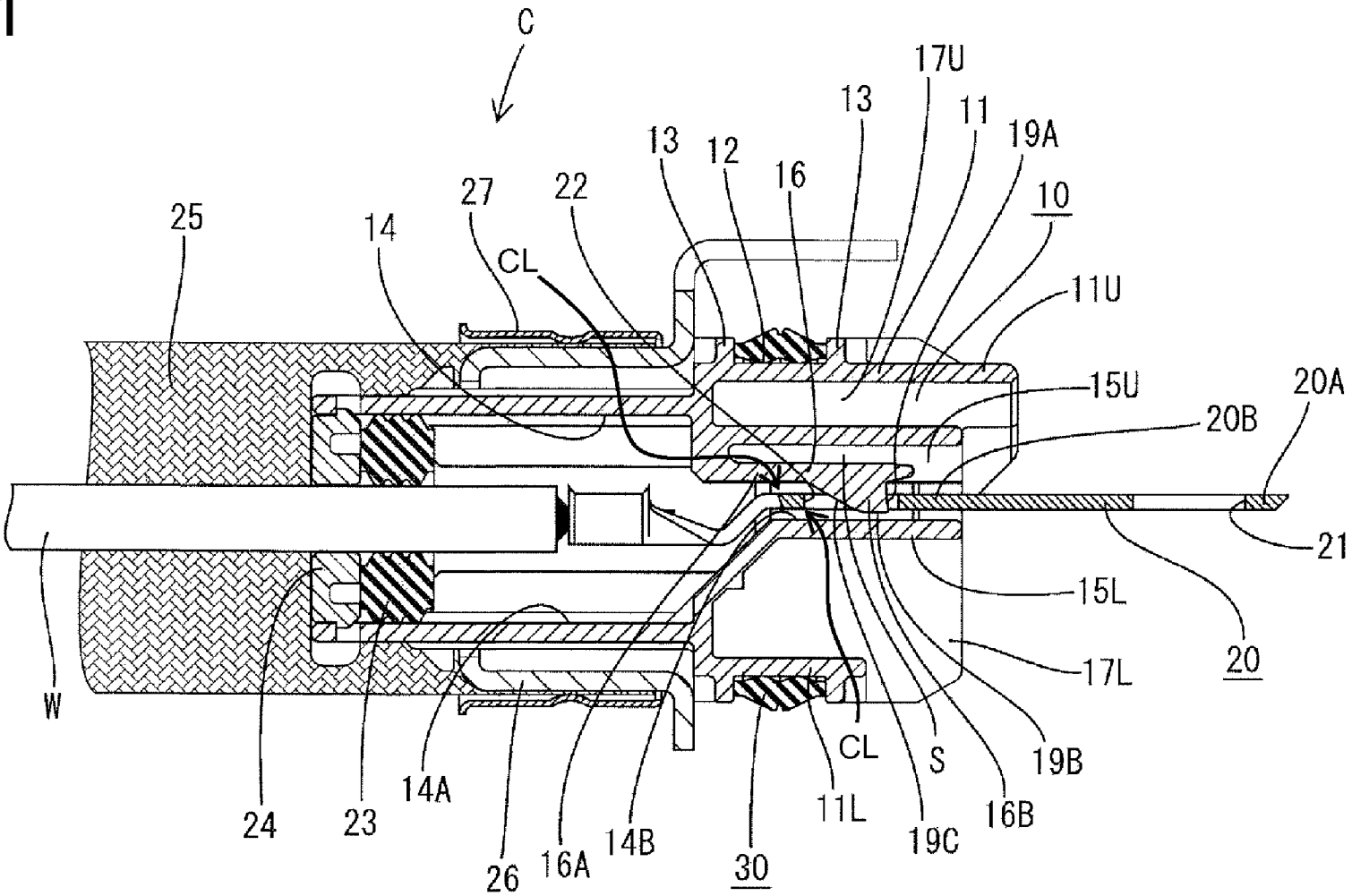
FIG. 1 is a side view in section of a connector according to one embodiment.

A connector in accordance with the invention is identified by the letter C in FIGS. 1 to 9. The connector C is to be fit in a mounting hole 41 of a shielding case 40 of an unillustrated device (e.g. an inverter, motor or the like of an electric vehicle).

The connector C includes a housing 10 made e.g. of synthetic resin. A front portion of the housing 10 is to be fit in the mounting hole 41 of the shielding case 40 and a rear portion thereof projects out from the shielding case 40 (see FIG. 9).

Each terminal 20 accommodated in the housing 10 is long in forward and backward directions. A connecting portion 20A is formed at the front end of each terminal 20 and is formed with a bolt hole 21. The connecting portion 20A is placed on an upper surface a terminal mount T and is secured by a bolt.

Figure 2:
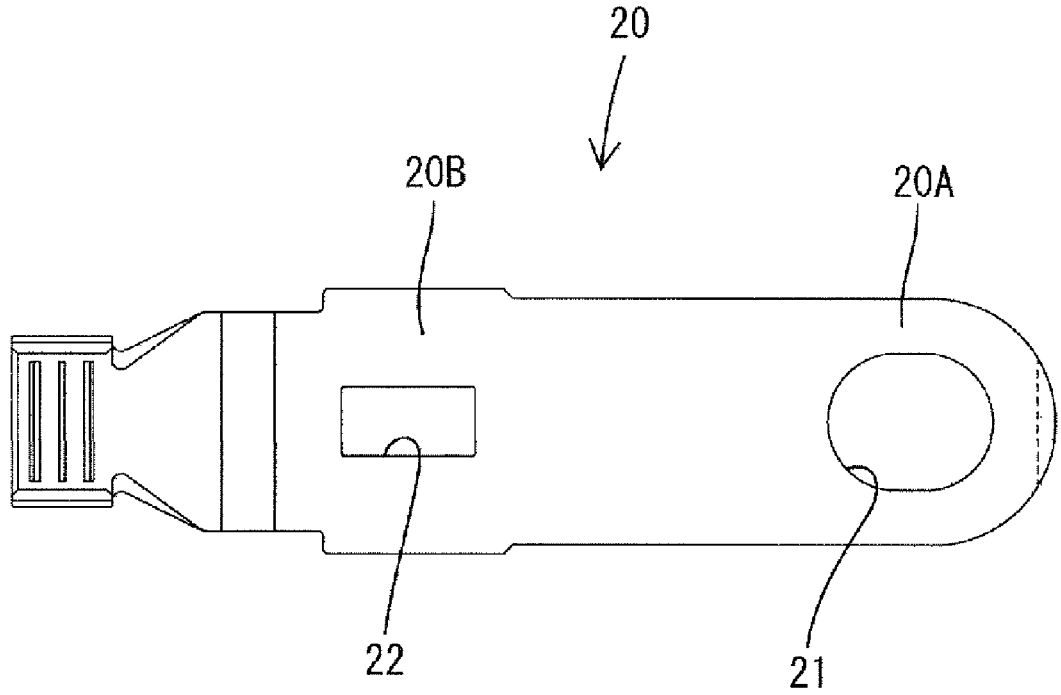
FIG. 2 is a plan view of a terminal.
Figure 3:
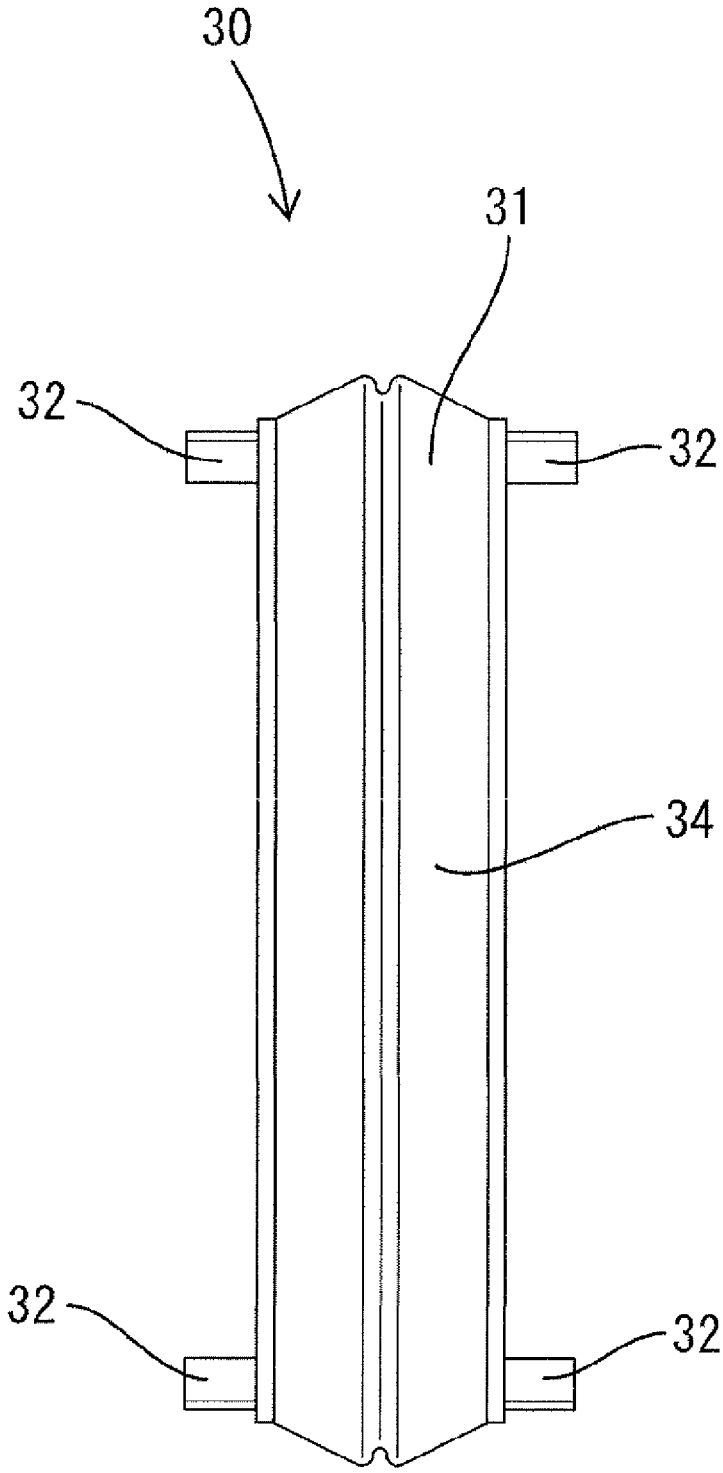
FIG. 3 is a side view of a seal ring.
Figure 4:
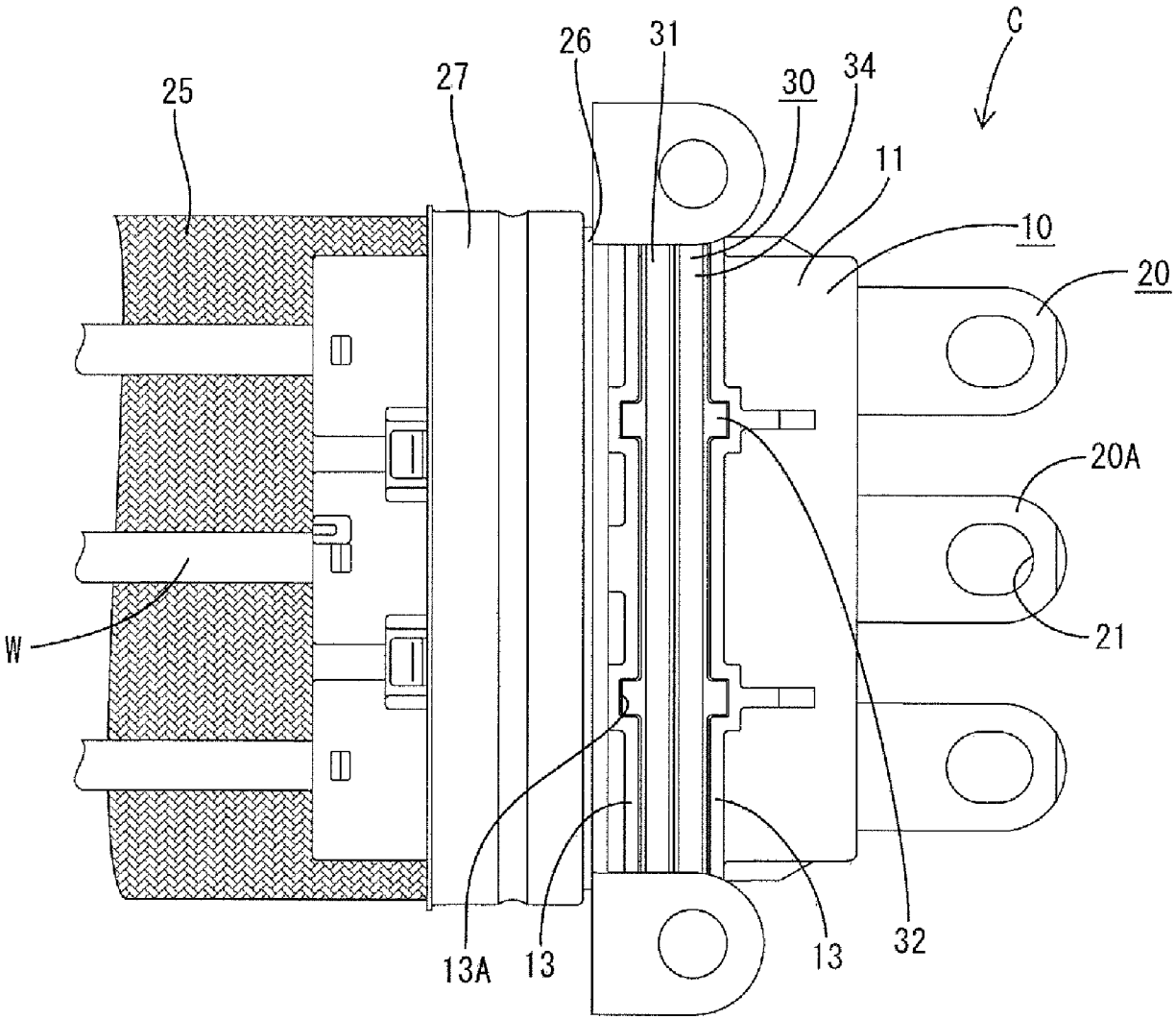
FIG. 4 is a plan view of a connector.
Figure 5:
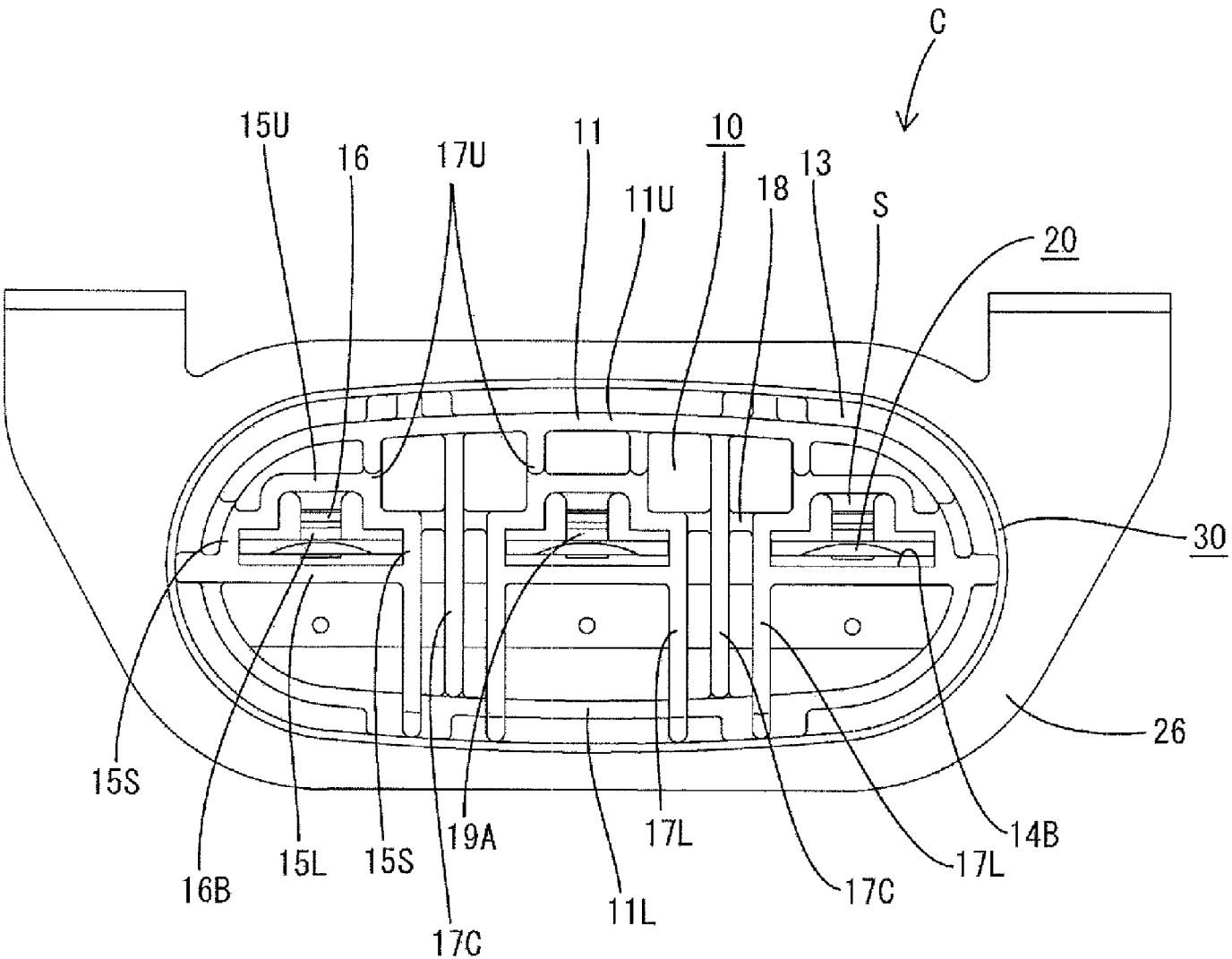
FIG. 5 is a front view of the connector.
Figure 6:
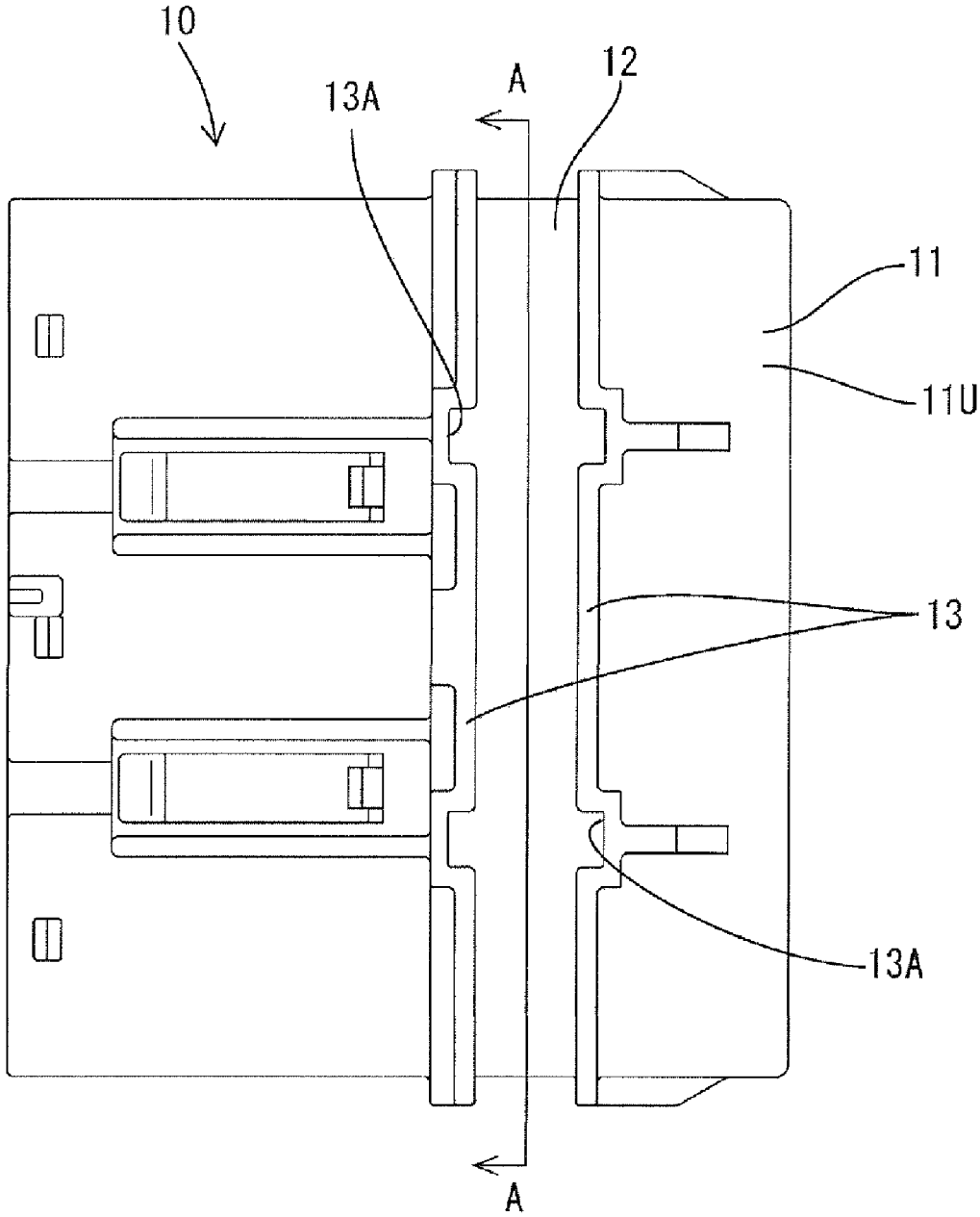
FIG. 6 is a plan view of a housing.
Figure 7:
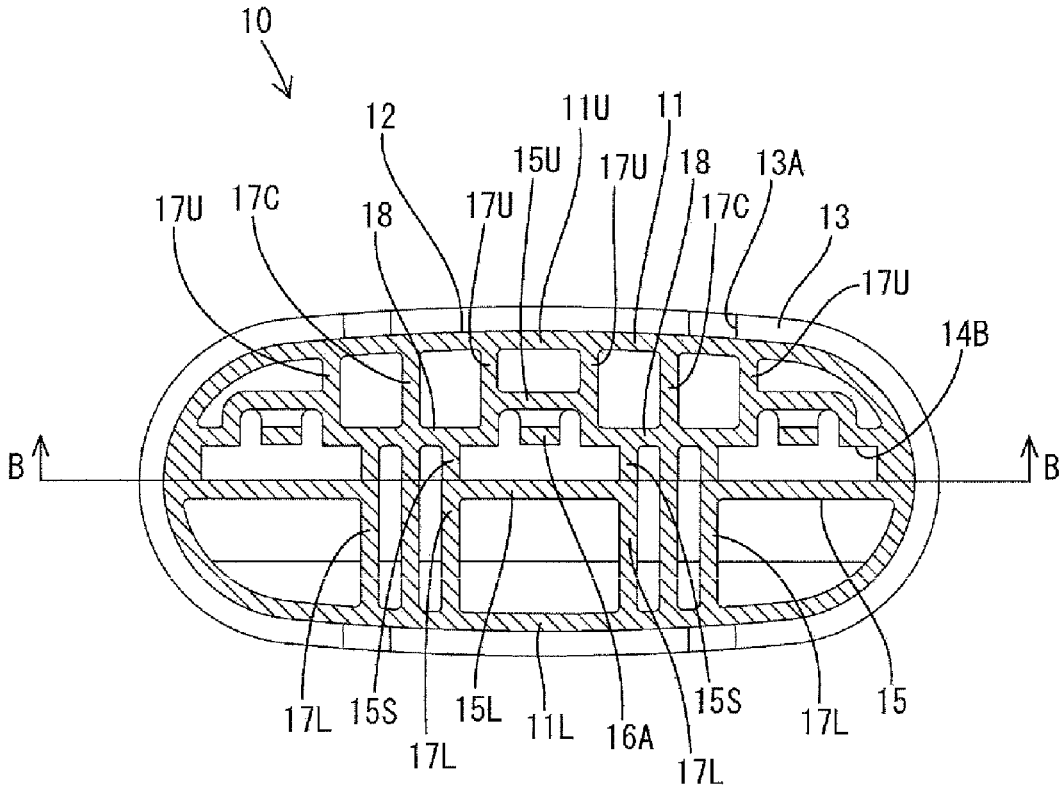
FIG. 7 is a section along A-A of FIG. 6.
Figure 8:
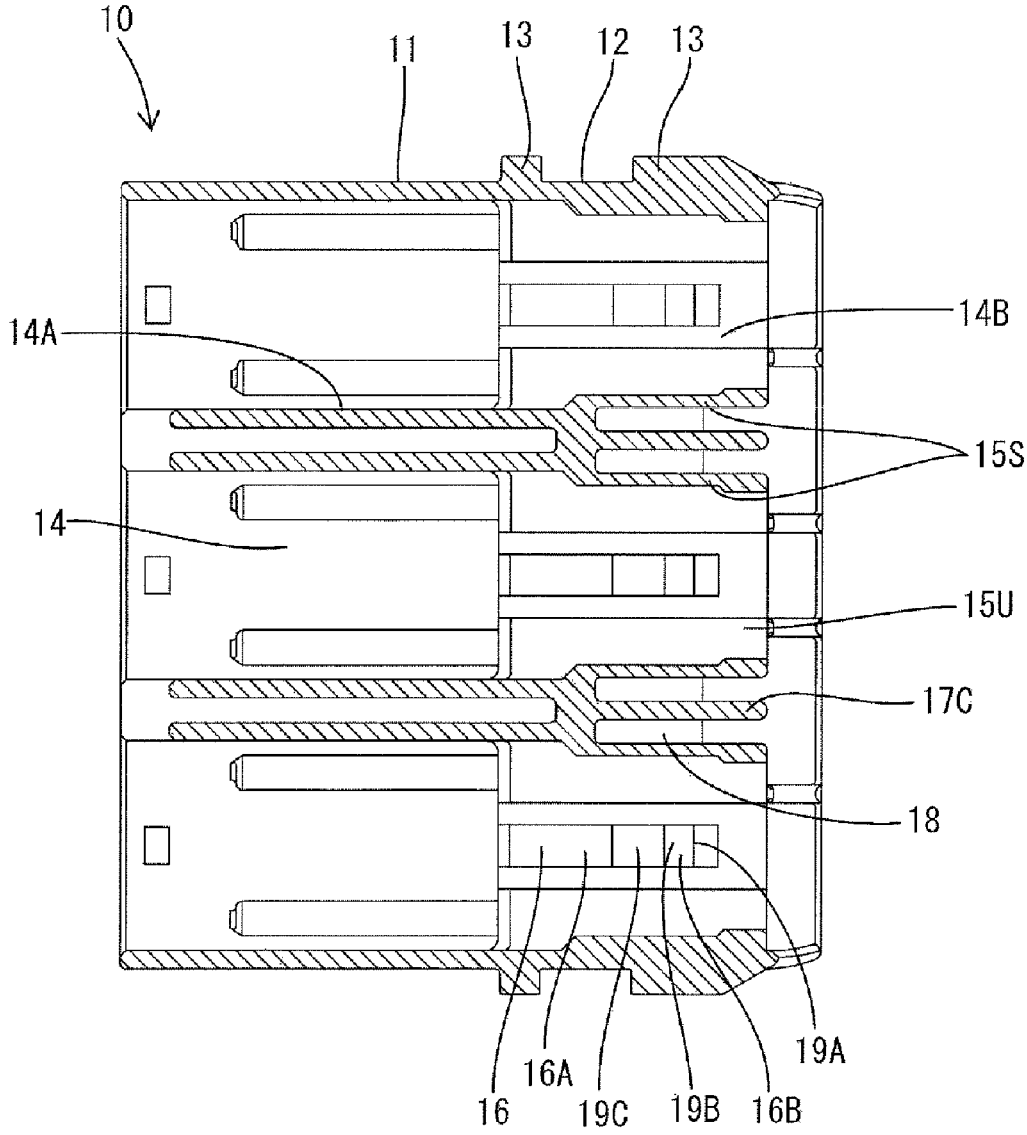
FIG. 8 is a plan view in section of a housing along B-B of FIG. 7.

An engageable portion 20B is formed at the rear end of the terminal 20 and is formed with an engaging hole 22. As shown in FIG. 2, the engaging hole 22 is a substantially rectangular shape that is longer in forward and backward directions. The width of the engaging hole 22 is less than the width of the bolt hole 21, preferably is less than about ⅔ of the width of the bolt hole 21, and more preferably is about half the width of the bolt hole 21. The engaging hole 22 is formed at a widthwise middle position of the engageable portion 20B of the terminal 20. Parts of the engageable portion 20B at the opposite sides of the engaging hole 22 are wider than the engaging hole 22, and the engageable portion 20B has strength sufficient to withstand the engagement with the engaging projection 16B.

A wire W is connected with the rear end of the terminal 20 preferably by insulation displacement. A substantially cylindrical resilient plug 23 is mounted fluid-tight on the insulation coating of each wire W, and provides fluidtightness or waterproofing between the wire W and a cavity 14. A plug holder 24 is mounted to the rear end of the housing 10 for preventing the detachment of the resilient plugs 23 from the cavities 14, and the wires W are drawn out backward through the plug holder 24.

Three wires W drawn out through the plug holder 24 are covered by a tubular shield 25 formed by braiding a thin metal wire into a mesh and/or by a conductive film or tube for shielding. An end of the shield 25 is mounted on the outer peripheral surface of a shielding tube 26 fit on a rear of the housing 10, and is secured to the shielding tube 26 by crimping a crimp ring 27 or the like. The shielding tube 26 is connected electrically to the shielding case 40.

An outer surrounding wall 11 is provided on a substantially front half of the housing 10 and can be fit into the mounting hole 41 of the shielding case 40. The outer surrounding wall 11 has a substantially elliptical tubular shape that is long in an arrangement direction of the cavities 14. A rear portion of the outer circumferential surface of the outer surrounding wall 11 defines a seal ring mounting surface 12, on which a seal ring 30 is mounted.

Two mounting walls 13 extend continuously and circumferentially on the outer circumferential surface of the outer surrounding wall 11 at opposite front and rear ends of the seal ring mounting surface 12. The mounting walls 13 have engaging recesses 13A deformed in directions to widen the spacing between the mounting walls 13 (see FIG. 4). The engaging recesses 13A have substantially rectangular shapes and are provided at four positions on each of the upper and lower surfaces of the housing 10, i.e. at a total of eight positions.

The seal ring 30 is made of a resilient material, such as rubber, and has an annular main body 31 to be mounted on the seal ring mounting surface 12. Engaging pieces 32 are provided at opposite front and rear ends of the seal ring main body 31. The seal ring main body 31 has a substantially elliptical shape longer in a width direction and substantially conforming to the shape of the outer surrounding wall 11. The engaging pieces 32 are arranged on the longer sides, with four engaging pieces 32 provided at each of the front and rear sides, i.e. a total of eight engaging pieces 32 are provided. The respective engaging pieces 32 are fit into the corresponding engaging recesses 13A of the mounting walls 13 to prevent circumferential movements of the seal ring 30.

Two lips 33 are formed on the inner circumferential surface of the seal ring main body 31 of the seal ring 30 and extend substantially continuously in the circumferential direction. The outer circumferential surface of the seal ring 30 has a bulge 34 shaped so that the outer diameter is largest at a center position in forward and backward directions. A circumferentially extending groove is formed at the tip of this bulge 34. The seal ring 30 is held in close contact with the seal ring mounting surface 12 by resilient compressions of the lips 33 and the bulge 34.

Three cavities 14 are arranged in the width direction of the housing 10 and penetrate the housing 10 substantially in forward and backward directions. The cavities 14 are dimensioned to receive the respective terminal fittings 20

A wire accommodating portion 14A is defined at the rear portion of each cavity 14 for accommodating the wire W. Each wire accommodating portion 14A has a circular cross section dimensioned so that the resilient plug 23 mounted on the wire W can be fit hermetically therein. A terminal accommodating portion 14B is defined at a front portion of each cavity 14 for accommodating the engageable portion 20B of the terminal 20. the terminal accommodating portion 14B has a wide narrow cross-sectional shape narrow, and extends up at its widthwise intermediate part (see FIG. 5).

The terminal accommodating portion 14B of each cavity 14 is at least partly surrounded by a surrounding wall 15. Each surrounding wall 15 includes two side panels 15S spaced apart in the width direction, a horizontal lower panel 15L connecting bottom ends of the side panels 15S, and a horizontal upper panel 15U connecting upper ends of the side panels 15S. A widthwise middle part of the upper panel 15U projects up to accommodate the resin locking lance 16. The thickness of the surrounding wall 15 is substantially equal in its entirety. Three surrounding walls 15 are arranged in the width direction inside the outer surrounding wall 11. The surrounding walls 15 at the opposite sides are united with the opposite ends of the outer surrounding wall 11 without any clearances. The lower panels 15L face the resin locking lances 16.

Upper, lower and central vertical reinforcing walls 17U, 17L and 17C horizontal reinforcing walls 18 are connected with the inner surface of the outer surrounding wall 11 at positions for receiving a resilient force from the seal ring 30. The vertical reinforcing walls 17U, 17L and 17C extend substantially at right angles to upper and lower longer sides 11U, 11L of the outer surrounding wall 11, and the horizontal reinforcing walls 18 extend substantially parallel to the upper and lower longer sides (see FIG. 7).

The horizontal reinforcing walls 18 extend substantially horizontally to connect the upper panels 15U of the adjacent surrounding walls 15. Two horizontal reinforcing walls 18 and the upper panels 15U of the surrounding walls extend 15 horizontally to connect the opposite widthwise ends of the outer surrounding wall 11.

The central vertical reinforcing walls 17C extend substantially vertically between the adjacent surrounding walls 15 to connect the upper and lower longer sides 11U, 11L of the outer surrounding wall 11. The central vertical reinforcing walls 17C are provided at a total of two positions, and cross the horizontal reinforcing walls 18 substantially perpendicularly at substantially widthwise middle positions of the respective horizontal reinforcing walls 18.

The upper vertical reinforcing walls 17U extend substantially vertically to connect the upper panels 15U of the surrounding walls 15 and the upper longer side 11U of the outer surrounding wall 11. Two upper vertical reinforcing walls 17U extend up from the left and right corners of the projecting part of the upper panel 15U of the centermost surrounding wall 15 in FIG. 7, and two upper vertical reinforcing walls 17U extend up from the more central corners of the projecting part of the upper wall 15U of the left and right surrounding walls 15 is FIG. 7.

The lower vertical reinforcing walls 17L extend vertically below the surrounding walls 15 at opposite sides of the central vertical reinforcing walls 17C to connect the lower panels 15L of the surrounding walls 15 and the lower longer side 11L of the outer surrounding wall 11. More particularly, one lower vertical reinforcing wall 17L extends down from the lower left corner of the surrounding wall 15 at the right end in FIG. 7, one lower vertical reinforcing wall 17L extends down from the right lower end corner of the surrounding wall 15 at the left end in FIG. 7, and two lower vertical reinforcing walls 17L extend down from the opposite corners of the center surrounding wall 15.

The upper vertical reinforcing walls 17U are substantially coplanar with the side walls of the projecting parts of the upper panels 15U. Similarly, the lower vertical reinforcing walls 17L extend down from the bottom ends of the side panels 15S and are substantially coplanar with the side panels 15S. The thickness of the vertical reinforcing walls 17 substantially equals the thickness of the surrounding walls 15. Thus, surfaces of the upper vertical reinforcing walls 17U are substantially flush with the surfaces of the side walls of the projecting parts, and surfaces of the lower vertical reinforcing walls 17L are substantially flush with the wall surfaces of the side panels 15S. Furthermore, the vertical dimension of the lower vertical reinforcing walls 17L is more than (preferably more than about two times, more preferably about three times) the vertical dimension of the upper vertical reinforcing walls 17U.

The locking lance 16 has a main body 16A cantilevered forward along the upper panel 15U from the rear end of the wire accommodating portion 14A and the engaging projection 16B projects in and down from the main body 16A. The resin locking lance 16 is resiliently deformable up and down in a direction intersecting an insertion direction of the terminals 20 and a deformation space S is defined above the locking lance 16 (between the locking lance 16 and the upper panel 15U) to enable upward resilient deformation of the locking lance 16.

The lower surface of the main body 16A of the locking lance 16 and the upper surface of the lower panel 15L of the cavity 14 are substantially parallel when the locking lance 16 is in a natural state and not deformed up or down. Additionally, the lower surface of the main body 16A of the locking lance 16 is at substantially the same vertical height as the lower surfaces of the opposite sides of the upper panel 15U excluding the projecting part (see FIG. 7). Thus, a vertical spacing between the lower surface of the main body 16A of the locking lance 16 and the upper surface of the lower panel 15L substantially equals a vertical spacing between lower panel 15L and the lower surfaces of parts of the upper panel 15U at the opposite sides of the locking lance 16 and the upper surface of the lower panel 15L, i.e. the vertical dimension of the terminal accommodating portion 14B of the cavity 14, is substantially constant.

The engaging projection 16B projects down and in from the lower surface of the main body 16A of the locking lance 16 and a vertically aligned engaging surface 19A is defined on a front part of the engaging projection 16B for engaging an edge of the engaging hole 22. A horizontal surface 19B extends along the projecting end of the engaging projection 16B and is aligned substantially parallel to the lower panel 15L of the cavity 14. A riding surface is defined at the rear of the engaging projection 16B and has a projecting distance from the main body 16A that decreases gradually towards the back side from the rear edge of the horizontal surface 19B.

A clearance CL is provided between the lower and upper panels 15L and 15U of the cavity 14 at opposite sides of the resin locking lance 16 and between the lower panel 15L of the cavity 14 and the main body 16A of the locking lance 16 for permitting vertical displacement of the terminal 20. This clearance CL is in addition to an accommodation space for the engageable portion 20B of the terminal 20 (i.e. the thickness of the terminal 20) and defines a vertical dimension in a range of about twice to about three times the thickness of the terminal 20 (preferably slightly less than about the three times the thickness of the terminal 20). The clearance CL permits displacement of the terminal 20 and is set in accordance with a supposed error range. In this embodiment, this clearance CL exceeds the sum of an error of the terminal mount T, an error of the terminal 20 and an error of the housing 10.

The engageable portion 20B of the terminal 20 is at a vertically intermediate position between the main body 16A of the resin locking lance 16 and the lower panel 15L of the cavity 14 when the terminal 20 is accommodated in the cavity 14, as shown in FIG. 1. Thus, clearances CL above the terminal 20 (between the terminal 20 and the main body 16A of the resin locking lance 16 or the upper panel 15U) and below the terminal 20 (between the terminal 20 and the lower panel 15L) are substantially equal. At this time, the connecting portion 20A of the terminal 20 projects forward from the housing 10.

A projecting distance of the engaging projection 16B exceeds a difference between the vertical spacing between the lower surface of the main body 16A of the locking lance 16 and the lower panel 15L of the cavity 14 and the thickness of the terminal 20, i.e. longer than the clearance CL. The engaging projection 16B projects down from the lower surface of the terminal 20 when the resin locking lance 16 is in the natural or undeflected state, and only a clearance CL smaller than the thickness of the terminal 20 is defined between the horizontal surface 19B of the engaging projection 16B and the lower panel 15L of the cavity 14. A projecting distance of the engaging projection 16B may be set in consideration of the thickness of the terminal 20 and the size of the clearance CL.

The connecting portion 20A of the terminal 20 projects forward from the housing 10 and is fixed (preferably bolted) to the terminal mount T of the shielding case 40. Height positions of the upper surface of the terminal mount T and the lower surface of the connecting portion 20A might not coincide. Thus, the upper surface of the terminal mount T may be distanced up or down from the opposed lower or upper surfaces of the connecting portion 20A. Such an error between the vertical position of the connecting portion 20A of the terminal 20 and the vertical position of the terminal mount T could cause the terminal 20 to deform and could press the engageable portion 20B against upper lower panels of a cavity or against the main body of the resin locking lance, if no clearance was provided in the terminal accommodating portion of the cavity for permitting displacements of the terminal 20. In this case, the terminal 20 would be pressed against the surrounding wall of the cavity or the resin locking lance and these forces could result in breakage. However, the subject invention has the clearance CL in the cavity 14 to absorb an error in the position of the terminal 20. Accordingly, the terminal 20 will not be pressed against the surrounding wall 15 or the resin locking lance 16, and breakage due to such pressure is avoided.

Figure 9:
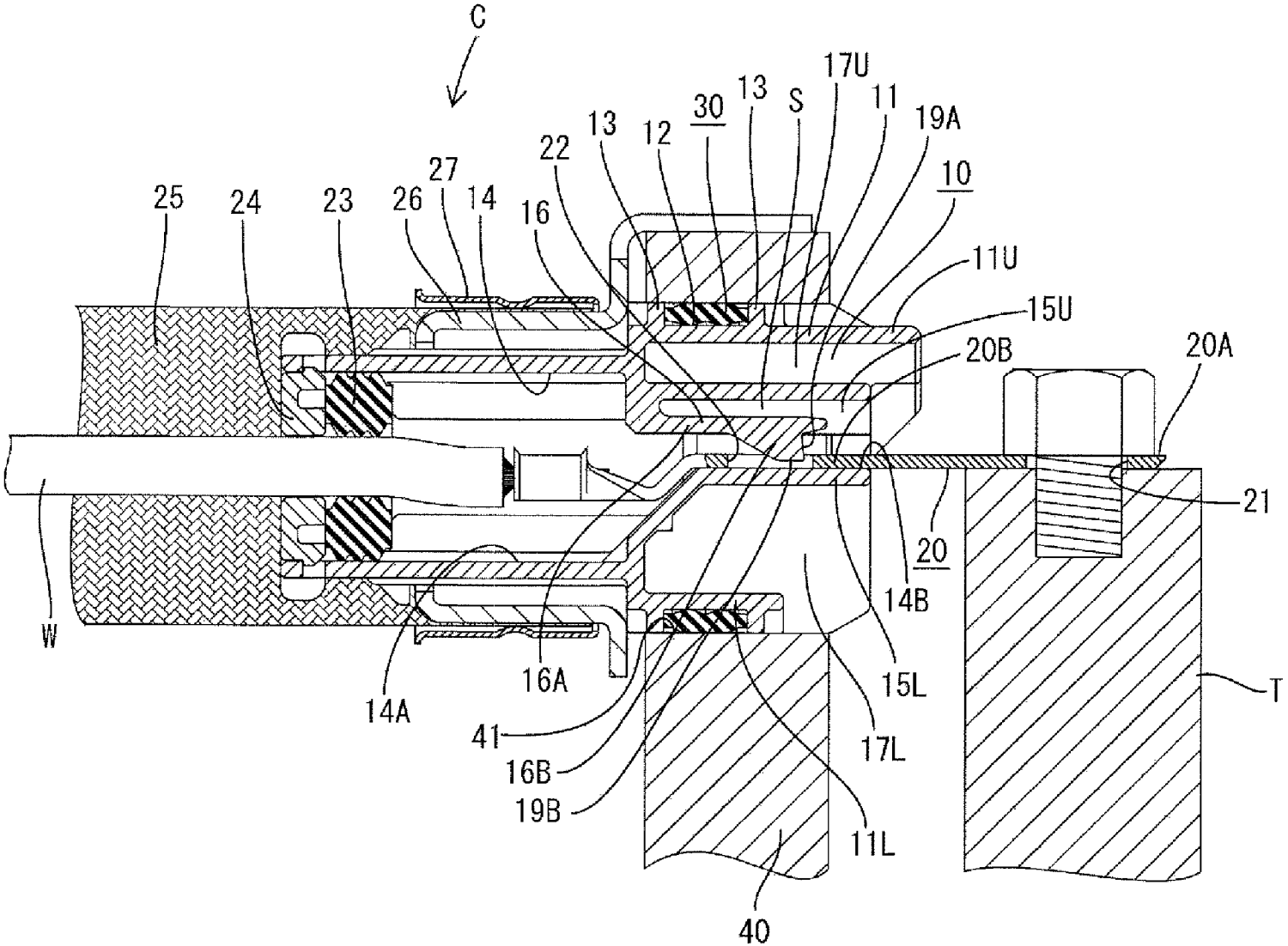
FIG. 9 is a side view in section of the connector showing a state where an error is absorbed by a displacement of the terminal.

The terminal 20 could be displaced towards the side of the cavity 14 where the resin locking lance 16 is not provided and hence in a direction to disengage the engaging projection 16B from the engaging hole 22. The engaging hole 22 could disengage from the engaging projection 16B if the projecting distance of the engaging projection 16B was insufficient. However, the projecting distance of the engaging projection 16B is sufficiently long. Thus, the engaging projection 16B and the engaging hole 22 remain engaged and the terminal 20 is retained reliably by the locking lance 16 (see FIG. 9) even if the engageable portion 20B of the terminal 20 is displaced maximally from the locking lance 16. FIG. 9 shows a state where the terminal 20 is displaced down while remaining substantially horizontal. An error as described above can also be absorbed by a displacement of the terminal 20 in its oblique posture (e.g. in a posture where the crimped connection with the wire W is higher than the connecting portion). However, the engaging hole 22 and the engaging projection 16B are held engaged even in such an oblique posture.

The resin locking lance 16 is provided in the upper panel 15U of the surrounding wall 15 of the cavity 14 to be located above the terminal 20. Here, if the resin locking lance 16 is located below the terminal 20, the weight of the terminal 20 may act on the resin locking lance 16. Since the terminal 20 preferably is made of metal, the weight thereof is large. Further, the resin locking lance 16 is a cantilever and has lower strength than the surrounding wall 15. Accordingly, the locking lance 16 is very durable and prevents the weight of the terminal 20 from acting on the resin locking lance 16.

The clearance CL for permitting the displacement of the terminal 20 exceeds the thickness of the terminal 20. Thus, neither the resin locking lance 16 not the surrounding wall 15 will be pressed by the terminal 20 if an error in the connected position of the terminal 20 (positions of the connecting portion 20A and the terminal mount T) lies within the thickness range of the terminal 20. The error will be absorbed mostly by the displacement of the terminal 20 even if the error in the connected position of the terminal 20 is larger than the thickness of the terminal 20. Thus, the pressing force produced between the terminal 20 and the resin locking lance 16 and/or the surrounding wall 15 is drastically lower as compared to the case where the error caused by the displacement of the terminal 20 is not absorbed significantly. As a result, breakage can be avoided.

The main body 31 of the seal ring 30 is compressed between the seal ring mounting surface 12 and the hole surface of the mounting hole 41 and closely contacts both surfaces when the connector C is mounted in the shielding case 40. Thus, sealing is provided between the shielding case 40 and the connector C and the seal ring mounting surface 12 is pressed inwardly by the seal ring 30. The vertical reinforcing walls 17U, 17L, 17C and the horizontal reinforcing walls 18 are provided on the inner side of the outer surrounding wall 11. Thus, deformation of the outer surrounding wall 11 is prevented even if the seal ring mounting surface 12 is pressed by the seal ring 30. Here, if the reinforcing walls are connected, for example, with the widthwise middle positions of the lower panels of the surrounding walls unlike this embodiment, there is a likelihood that the lower panels would deform and warp inwardly (up) upon receiving forces from the reinforcing walls. If the surrounding walls were deformed, the specified clearances may not be defined in the cavities and it may be impossible to absorb the errors by the displacements of the terminals 20. However, in this embodiment, the vertical reinforcing walls 17U, 17L, 17C and the horizontal reinforcing walls 18 are connected with the corners of the surrounding walls 15, i.e. the parts of the surrounding walls 15 having higher rigidities than the other parts. Thus, the surrounding walls 15 are unlikely to deform, and clearances in the cavities 14 can be kept in specified sizes.

The vertical reinforcing walls 17U, 17L, 17C and the horizontal reinforcing walls 18 extend substantially parallel to the panels of the surrounding wall 15 from the corners of the surrounding wall 15. Thus, directions of forces that the surrounding walls 15 receive from the vertical reinforcing walls 17U, 17L, 17C or the horizontal reinforcing walls 18 substantially coincide with the directions of the panels of the surrounding walls 15. Bending rigidity in the wall surface direction of the surrounding wall 15 is drastically larger than that in the wall thickness direction. Thus, the surrounding walls 15 will not deform upon receiving forces from the vertical reinforcing walls 17 or the horizontal reinforcing walls 18.

As described above, an error in the connected position of the terminal 20 and the terminal mount T can be absorbed by the displacement of the terminal 20 in the cavity 14. Thus, the terminal 20 will not remain pressed against the resin locking lance 16 or the lower panel 15L without the displacement of the terminal 20 being permitted. Therefore durability is improved. The terminal 20 is retained reliably by the resin locking lance 16 even though there is the clearance CL for permitting displacement of the terminal 20.

The invention is not limited to the above described and illustrated embodiment. For example, the following embodiments are also embraced by the technical scope of the present invention as defined by the claims.

The invention is applied to the connector C to be fit into the mounting hole 41 of the shielding case 40 of the device in the above embodiment, it is applicable to various connectors without being limited to this application.

The resin locking lance 16 is in the form of a cantilever extending forward along the upper wall portion 15U in the above embodiment. However, the shape of the resin locking lance is not so limited. For example, the resin locking lance may be provided, for example, at the lower wall, may extend backward or may be supported on both ends.

The vertical and horizontal reinforcing walls 17 and 18 extend parallel to the panels of the surrounding wall 15 from the corners of the surrounding wall 15. However, the invention is not limited to this and they may extend, for example, in directions oblique to the panels from the corners of the surrounding wall.

The height of the lower surface of the main body 16A of the resin locking lance 16 and the height of the lower surfaces of the parts of the upper panel 15U at the opposite sides of the resin locking lance 16 coincide in the above embodiment. However, the invention is not limited to this embodiment. For example, the lower surface of the main body of the resin locking lance may be higher than the lower surface of the upper panel. In such a case, a clearance may be defined between the lower surface of the upper panel and the upper surface of the lower panel and the projecting distance of the engaging projection may be set so that the engaging projection is engageable with the terminal when the terminal is displaced towards the lower panel.

What is claimed is:

1. A connector, comprising:

a housing formed with at least one surrounding wall defining a cavity, the surrounding wall including at least first and second opposite panels, a locking lance provided at the first panel of the surrounding wall, the locking lance having a main body and an engaging projection projecting from the main body toward the second panel; and a terminal accommodated in the cavity and being engaged by the engaging projection of the locking lance, wherein a first clearance is defined between the terminal and the main body of the locking lance and a second clearance is defined between the terminal and the second panel of the surrounding wall of the cavity for permitting displacements of the terminal, a projecting distance of the engaging projection from the main body of the locking lance exceeding a sum of dimensions of the first and second clearances.

2. The connector of claim 1, wherein the first panel of the surrounding wall of the cavity is located above the terminal.

3. The connector of claim 1, wherein the clearance exceeds the thickness of the terminal.

4. The connector of claim 1, wherein the clearance is larger the sum of an error range of a terminal mount onto which the terminal is to be mounted, an error range of the terminal and an error range of the housing.

5. The connector of claim 1, wherein the locking lance (16) is a cantilever.

6. The connector of claim 1, further comprising an outer surrounding wall outside the surrounding wall of the cavity and a seal ring being mounted on an outer circumferential surface of the outer surrounding wall.

7. The connector of claim 6, further comprising at least one reinforcing wall extending between and joining the outer surrounding wall and the surrounding wall.

8. The connector of claim 7, wherein the reinforcing wall is connected with a corner of the surrounding wall (15).

9. The connector of claim 8, wherein the reinforcing wall extends substantially parallel to a panel of the surrounding wall.

10. A connector, comprising:

a housing formed unitarily of a synthetic resin and having a plurality of surrounding walls, the surrounding walls defining a corresponding plurality of cavities, each of the surrounding walls including opposite upper and lower panels spaced from one another by a selected distance, a locking lance being cantilevered at an intermediate position of the upper panel, the locking lance having a main body and an engaging projection projecting from the main body toward the lower panel; and terminals in the respective cavities and engaged by the engaging projection of the respective locking lance, each of the terminals having a thickness measured normal to the upper and lower panels, the distance between the upper and lower panels being at least twice the thickness of each of the terminals, wherein a projecting distance of the engaging projection from the main body of the locking lance exceeds a distance from the main body of the locking lance to the lower panel minus a thickness of the terminal.

11. The connector of claim 10, wherein the distance between the upper and lower panels is between two and three times the thickness of each of the terminals.

12. The connector of claim 10, further comprising an outer wall surrounding all of the surrounding walls, a plurality of reinforcing walls extending between and joining the outer wall and the surrounding walls.

13. The connector of claim 12, wherein surrounding walls are substantially tubular and the reinforcing walls are connected respectively with corners of the surrounding walls.

14. The connector of claim 13, wherein the reinforcing walls extend substantially parallel to panel of the surrounding walls.

15. The connector of claim 13, wherein each of the reinforcing walls is substantially coplanar with a panel of the corresponding surrounding wall.

16. A connector, comprising:

a housing formed unitarily of a synthetic resin and having a plurality of surrounding walls, the surrounding walls defining a corresponding plurality of cavities, each of the surrounding walls including opposite upper and lower panels spaced from one another by a selected distance, a locking lance being cantilevered at an intermediate position of the upper panel, the locking lance having a main body and an engaging projection projecting from the main body, an outer wall surrounding all of the surrounding walls and a plurality of reinforcing wall extending between and joining the outer wall and the surrounding walls;

terminals in the respective cavities and engaged by the engaging projection of the respective locking lance, each of the terminals having a thickness measured normal to the upper and lower panels, the distance between the upper and lower panels being at least twice the thickness of each of the terminals, a first clearance being defined between each of the terminals and the main body of the locking lance and a second clearance being defined between each of the terminals and the corresponding lower panel for permitting displacements of the terminals, a projecting distance of the engaging projection from the main body of the locking lance exceeding a sum of dimensions of the first and second clearances; and a seal ring being mounted on an outer surface of the outer wall.

* * * * *

UNITED STATES PATENT AND TRADEMARK OFFICE

CERTIFICATE OF CORRECTION

PATENT NO. : 7,597,589 B2
APPLICATION NO. : 12/248983
DATED : October 6, 2009
INVENTOR(S) : Masayuki Kawamura It is certified that error appears in the above-identified patent and that said Letters Patent is hereby corrected as shown below:

On the Title Page Item (54) should read
(54) CONNECTOR FOR ACCOMMODATING ERRONEOUS POSITIONING OF A TERMINAL IN A CAVITY Signed and Sealed this Tenth Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,597,589 B2
APPLICATION NO. : 12/248983
DATED : October 6, 2009
INVENTOR(S) : Masayuki Kawamura It is certified that error appears in the above-identified patent and that said Letters Patent is hereby corrected as shown below:

On the Title Page, Item (54) and Column 1, lines 1-3, title should read
CONNECTOR FOR ACCOMMODATING ERRONEOUS POSITIONING OF A TERMINAL IN A CAVITY This certificate supersedes the Certificate of Correction issued November 10, 2009.

Signed and Sealed this

First Day of December, 2009

David J. Kappos

David J. Kappos
*Director of the United States Patent and Trademark Office*